United States Patent [19]

Faylor

[11] Patent Number: 4,535,729

[45] Date of Patent: Aug. 20, 1985

[54] VEHICLE COOLING SYSTEM UTILIZING ONE RADIATOR

[75] Inventor: Lawrence E. Faylor, Dubuque, Iowa

[73] Assignee: Deere & Company, Moline, Ill.

[21] Appl. No.: 658,253

[22] Filed: Oct. 5, 1984

[51] Int. Cl.[3] ..... F01P 3/12

[52] U.S. Cl. ..... 123/41.1; 123/41.31; 123/41.33

[58] Field of Search ..... 123/41.02, 41.08, 41.09, 123/41.1, 41.31, 41.33

[56] References Cited

U.S. PATENT DOCUMENTS

| | | | |
|---|---|---|---|
| 2,435,041 | 1/1948 | Hild | 123/41.33 |
| 3,863,612 | 2/1975 | Wiener | 123/41.09 |
| 4,000,725 | 1/1977 | Harris | 123/41.31 |
| 4,061,187 | 12/1977 | Rajasekaran et al. | 123/41.31 |
| 4,325,219 | 4/1982 | Stang et al. | 60/599 |
| 4,362,131 | 12/1982 | Mason et al. | 123/41.31 |

*Primary Examiner*—William A. Cuchlinski, Jr.

[57] ABSTRACT

An integrated cooling system for cooling a vehicle engine and fluid from a plurality of auxiliary heat sources that is composed of a radiator having upper and lower cavities joined by a plurality of tubes with the lower cavity being divided into a plurality of separate sections. A plurality of coolers, each having an intake and outlet in communication with a heat source, and each being in communication with one of the sections of the radiator. A valve is positioned downstream of the respective coolers and determines the amount of coolant moving through the respective coolers prior to the time that the coolant moves into an engine pump that forces the coolant into the engine and through a suitable return back to the upper compartment of the radiator.

8 Claims, 2 Drawing Figures

VEHICLE COOLING SYSTEM UTILIZING ONE RADIATOR

BACKGROUND OF THE INVENTION

The present invention relates to a vehicle cooling system and more particularly relates to a cooling system utilizing only one radiator for providing cooling for most of the various heat sources which require cooling.

Industrial tractors, such as four-wheel-drive loaders, typically have more than one heat source which must be cooled. For example, these sources may include the engine, engine oil, torque converter oil and the hydraulic oil used for operating various functions of the vehicle and auxiliary equipment.

There are several disadvantages to cooling each source independent of the others. Primarily, these disadvantages relate to locating and mounting components of the various cooling systems. For example, it is common practice to mount oil cooling radiators either beside or forwardly or rearwardly of the radiators for the engine so as to share the flow of cooling air caused by the fan. Placing the radiators side-by-side results in a joint being between the radiators and thus, does not make efficient use of the air flow while placing the radiators, one in front of the other, makes the radiators more prone to being plugged by air-borne debris.

SUMMARY OF THE INVENTION

According to the present invention, there is provided an improved cooling system for various heat sources of a vehicle.

An object of the invention is to provide a vehicle cooling system which utilizes one radiator for removing heat from a coolant fluid which is routed to cool various heat sources.

A more specific object is to provide a cooling system wherein a single pump is used to draw coolant through two different paths for cooling two different heat sources and is used to discharge the coolant to two different paths for cooling two more different heat sources.

Yet another object of the invention is to provide a cooling system, as set forth above, wherein a flow control valve means is used to regulate the amount of coolant flowing to some heat sources to thereby regulate the degree of cooling at those heat sources.

These and other objects will become apparent from a reading of the following description, together with the appended drawings.

DESCRIPTION OF THE PREFERRED EMBODIMENT

Figure 1:
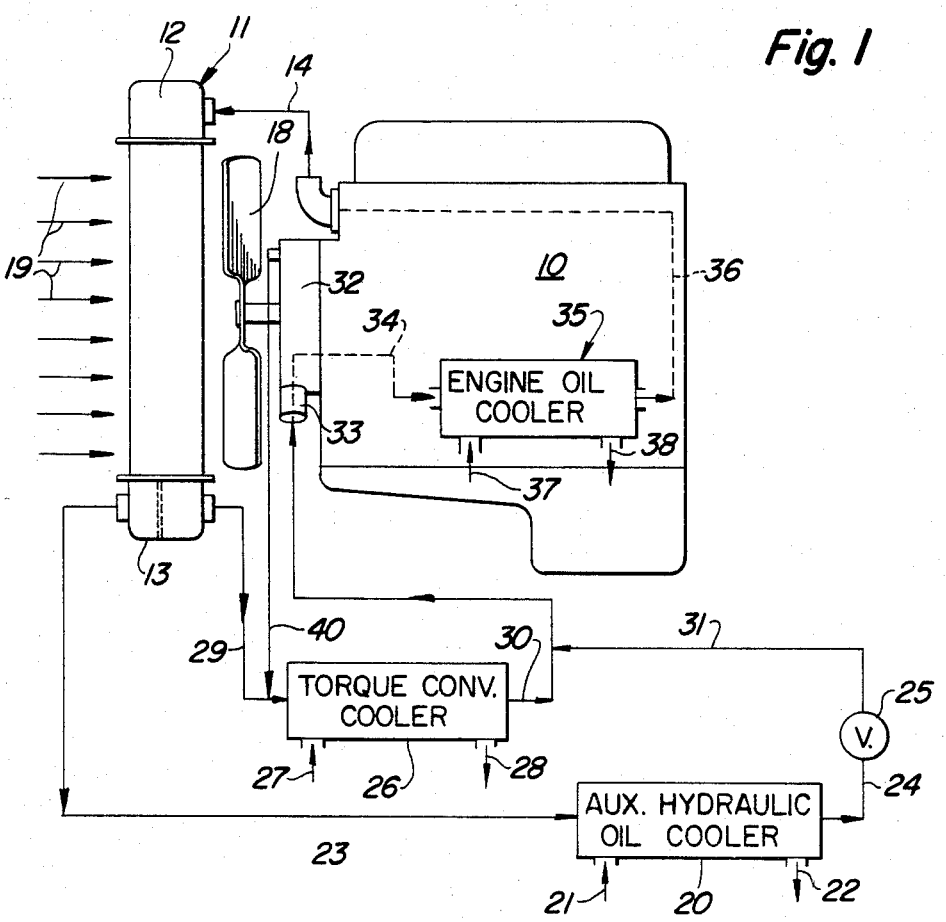
FIG. 1 is a schematic view of a cooling system for an engine and cooler units for oil used by auxiliary devices.
Figure 2:
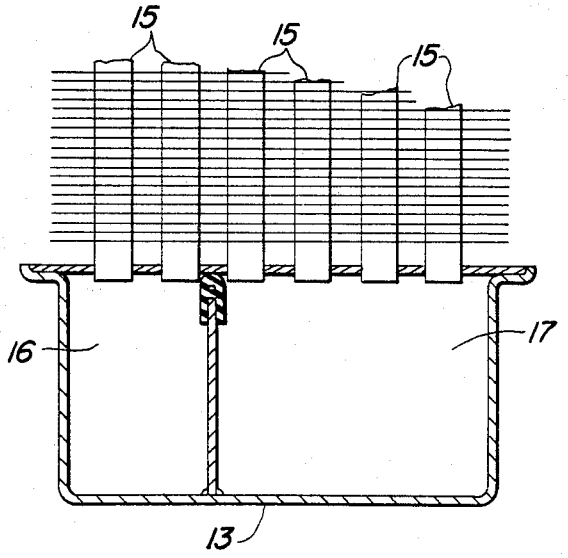
FIG. 2 is an enlarged and also schematic view of the lower end of the radiator used in the cooling system of FIG. 1.

Referring to FIG. 1, an engine 10, preferably of the internal combustion type, having a conventional-type water jacket for cooling the engine, has mounted forwardly thereof a radiator, indicated in its entirety by the reference numeral 11. The radiator 11 has upper and lower coolant departments or cavities 12, 13. The upper cavity 12 extends completely across the forward upper end of the radiator and is connected to the engine 10 by a return line 14. The cavities or compartments 12, 13 are connected or joined by a plurality of vertical tubes 15. The lower compartment or cavity 13 is divided into front and rear sections 16, 17 and part of the tubes 15 empty into the front section 16 and part of the tubes 15 empty into the rear compartment 17. A fan 18 is positioned between the engine 10 and radiator 11 and draws air, as indicated by the arrows 19, through the radiator for cooling of the coolant that moves through the entire system.

Although not shown, the engine 10 is utilized, for purposes of example, on a piece of industrial equipment that uses hydraulically-operated devices. As the hydraulic oil is used, it becomes a heat source and must be cooled. As a consequence, an auxiliary hydraulic oil cooler 20 is used in the present system and has an oil intake 21 and an oil outlet 22 for moving the oil through the cooler 20 and to and from the hydraulic device or devices, as the case may be. Coolant is moved from the front section 16 of the lower cavity or compartment 13 through a conduit 23 to the oil cooler 20. A discharged conduit 24 leads from the cooler to a valve 25, the purpose of which will later become apparent.

An hydraulically-operated torque converter, not shown, is also used in the vehicle and oil required to operate the converter must also be cooled. As a consequence, a second cooler 26 is provided and has an oil inlet 27 and an oil outlet 28 that receives the oil from the torque converter, moves it through the cooler 26 and through the outlet 28, where it moves it back to the converter. A coolant line 29 extends from the rear compartment 17 to the torque converter and a coolant line 30 discharges the coolant from the cooler 26.

Coolant moves through the valve 25 from the cooler 20 through a conduit 31 and joins the conduit 30 prior to it moving into a pump 32. The pump 32 has an inlet and the conduits 30, 31 move the coolant into the inlet. Most of the coolant moving through the pump 32 is dispensed into the block and head of the engine 10 where it is utilized to cool the engine. Part, however, moves through a conduit indicated at 34 to an engine oil cooler 35 to a coolant outlet 36 from where it moves the coolant to the return line 14. Similarly, the coolant in the block and head finds its way into the return line 14 in conventional manner. The engine oil cooler has an oil intake 37 that receives the warm oil from the engine crankcase and moves it through the cooler 35 to the outlet 38 from where it is returned to the crankcase.

While only three coolers have been shown, it should be recognized that other coolers for heat sources, such as might occur if the fluid from an air conditioner were moved through a cooler, would be a different type of fluid or gas, but the coolant could be utilized, although it may well need a different temperature than the other coolers require. The valve 25 is utilized to restrict, in most instances, the amount of coolant in the movement of coolant through the auxiliary oil cooler 20. This is for the reason that the oil cooler 20 requires more cooling than does, for example, the torque converter cooler. A by-pass coolant tube 40 extends from the upper block portion of the engine 10 and is connected to the conduit 29 leading into the torque converter cooler 26. As occurs in most engines, thermostats are utilized to bring the engine coolant up to temperature in a short period of time. However, when the engine is first started, the coolant is not of sufficient temperature to open the thermostat. Consequently, the by-pass conduit 40 is utilized to move coolant from the engine to the torque converter. The coolant control valve 25 is therefore utilized only to control the flow of fluid first through the cooler 20 and, to a degree, through the cooler 26, since the coolant that is restricted from moving up through the cooler 20 will be restricted in the section 16 of the lower cavity and eventually, in the upper compartment or cavity 12 where it will then flow predominently into the cavity 17 and in through the cooler 26. If additional coolers were used, however, it would be necessary to provide valves for the addition of coolers and possibly, divide the lower cavity or compartment 13 into additional sections.

While the invention has been described in conjunction with a specific embodiment, it is to be understood that many alternatives, modifications and variations will be apparent to those skilled in the art in light of the aforegoing description. Accordingly, this invention is intended to embrace all such alternatives, modifications and variations which fall within the spirit and scope of the appended claims.

I claim:

1. An integrated cooling system for cooling a vehicle engine, transmission oil, and auxiliary hydraulic function oil, comprising: a radiator having upper and lower cavities joined by a plurality of tubes, said lower cavity being divided into first and second separate sections; a coolant pump having an intake and a discharge, the latter being connected to the engine for cooling thereof; a first oil cooler having an oil intake and outlet in communication with and for circulating the transmission oil in the cooler, said cooler having a connection to said first section for transferring coolant from the latter to said first oil cooler; a second oil cooler having an oil inlet and outlet in communication with and for circulating auxiliary hydraulic oil through the cooler, said latter cooler having a connection to the coolant in said second section for transferring coolant from said second section to said second cooler; first and second coolant discharge conduit means receiving the respective coolant from the first and second coolers and connected to the intake of the pump; a valve means in said conduit means for controlling the quantity and temperature of coolant moving through the respective coolers; and a return from the engine to said upper cavity.

2. The invention defined in claim 1, further characterized by a thermostat control on the engine for regulating the temperature of coolant moving through the return, and a bypass line extending between the engine and at least one cooler for maintaining coolant flow through the cooler when said thermostat is closed.

3. An integrated cooling system for cooling a vehicle engine and oil from two auxiliary oil functions comprising: a radiator having upper and lower cavities joined by a plurality of tubes, said lower cavity being divided into first and second separate sections; a coolant pump having an intake and discharge, the latter being connected to the engine for cooling thereof; a high temperature oil cooler having an oil intake and outlet in communication with and for circulating the oil through the cooler from one of the oil functions, said cooler having a connection to said first section for transferring coolant from the latter to said high temperature oil cooler; a low temperature oil cooler having an oil inlet and outlet in communication with and for circulating oil from the other of the oil functions through the low temperature cooler, said latter cooler having a connection to the coolant in said second section for transferring coolant from said second section to said low temperature cooler; coolant discharge conduit means receiving the respective coolants from the high and low temperature coolers and connected to the intake of the pump; a valve means in said conduit means for controlling the quantity and temperature of coolant moving through the respective cooler; and a return from the engine to the upper cavity.

4. The invention defined in claim 3, further characterized by a bypass line extending from the engine to the high temperature cooler for circulating coolant through the latter when the engine is being brought up to normal operating temperature.

5. The invention defined in claim 4 in which the valve means is a valve in a conduit forming part of said valve means that restricts flow of fluid through said second section and said low temperature cooler.

6. An integrated cooling system for cooling a vehicle engine and fluid from a plurality of auxiliary hea. sources, comprising: a radiator having upper and lower cavities joined by a plurality of tubes, said lower cavity being divided into a plurality of separate sections; a coolant pump having an intake and a discharge, the latter being connected to the engine for cooling thereof; a plurality of coolers, each having an intake and outlet in communication with and for circulating a fluid from one of the heat sources through one of the coolers, each of said coolers further having connections to said sections of the lower cavity for transferring coolant from the latter to the respective coolers; a coolant discharge means receiving the coolants from the respective coolers and connected to the intake of the pump; valve means for controlling the quantity of coolant moving through the respective cooler and respective, sections in said lower cavity; and a return from the engine to the upper cavity.

7. The invention defined in claim 6, further characterized by the heat source utilizing oil as its fluid, said coolers are oil coolers, and said discharge means for the oil coolers combines downstream discharge coolants from the coolers into a single source feeding coolant to the intake of the pump.

8. The invention defined in claim 7, further characterized by said valve means being positioned in said discharge means upstream from where the discharge coolants are combined.

* * * * *

UNITED STATES PATENT AND TRADEMARK OFFICE

CERTIFICATE OF CORRECTION

PATENT NO. : 4,535,729

DATED : October 5, 1984

INVENTOR(S) : Lawrence E. Faylor

It is certified that error appears in the above-identified patent and that said Letters Patent is hereby corrected as shown below:

Column 4, line 29, "hea." should read -- heat --.

Signed and Sealed this

*Thirteenth* Day of *May 1986*

[SEAL]

*Attest:*

DONALD J. QUIGG

*Attesting Officer*

*Commissioner of Patents and Trademarks*